US006380676B1

(12) United States Patent
Bánkuti et al.

(10) Patent No.: US 6,380,676 B1
(45) Date of Patent: Apr. 30, 2002

(54) DISCHARGE LAMP WITH END OF LIFE ARC EXTINGUISHING STRUCTURE

(75) Inventors: László Bánkuti, Erdósor; Miklós György, Zemplényi; Barnabás Nagy, Aradi; Csaba Trajber, Zöldfa, all of (HU)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/476,541

(22) Filed: Jan. 3, 2000

(51) Int. Cl.[7] ..... H01J 17/04; H01J 1/62

(52) U.S. Cl. ..... 313/574; 313/577; 313/563; 313/331; 313/489

(58) Field of Search ..... 313/572, 574, 313/577, 484, 563, 566, 489, 331

(56) References Cited

U.S. PATENT DOCUMENTS 5,449,971 A 9/1995 Scott et al. ..... 313/631
5,585,693 A 12/1996 Shaffer ..... 313/489
5,705,887 A 1/1998 Shaffer ..... 313/489
5,841,220 A * 11/1998 Ooms ..... 313/490 X
6,043,603 A * 3/2000 Weinhardt ..... 313/566

* cited by examiner

*Primary Examiner*—Ashok Patel

(57) ABSTRACT

A discharge lamp comprises a discharge tube having discharge electrodes (10) at both ends thereof. Two lead wires (8) are connected to each of said electrodes (10) that lead to the outside atmosphere from the inside of the discharge tube. The discharge tube contains a fill as an arc discharge generating and sustaining medium. A tungsten coil (14) is connected to at least one lead wire (8) of at least one electrode (10) and placed adjacent to said electrode (10). At least one material selected from the group consisting of calcium carbonate, barium carbonate and strontium carbonate is applied to the inside and the surface of the tungsten coil (14).

6 Claims, 1 Drawing Sheet

DISCHARGE LAMP WITH END OF LIFE ARC EXTINGUISHING STRUCTURE

FIELD OF THE INVENTION

This invention relates to a discharge lamp with arc extinguishing structure, and more particularly, to a discharge lamp which has an arc extinguishing structure coming into action at the end of life of the lamp.

BACKGROUND OF THE INVENTION

The electron emission of the discharge tube is ensured by the electrode coating. At the end of lamp life, the electrode coating is used up, the emission capability decreases and the lamp voltage increases. As a consequence, the temperature of the electrode and the component parts in its vicinity significantly increases which leads to the breakage of parts, gas formation, melting of the plastic parts and burning-in of the lampholder. This harmful increase in temperature is avoided in a known way by releasing arc extinguishing gases from a structure located in the immediate vicinity of the electrode. The arc extinguishing gases have relatively low molecular weight but high ionization energy. So the lamp will extinguish and will not start any more. The component parts and objects in the vicinity of the lamp will not be endangered any longer.

An end of life arc extinguishing structure is described in U.S. Pat. No. 5,449,971. In this structure, glass beads containing $CaCO_3$ are melted on the electrode lead wires, and $CO_2$ is released on the effect of an increase in the temperature of the lead wire. Strontium carbonate (for higher temperatures) and barium carbonate may also be used. The decomposition temperature of $CaCO_3$ is 525 to 550° C. and the decomposition temperatures of $SrCO_3$ and $BaCO_3$ are higher. A disadvantage of this structure is that the glass bead must soften below this temperature. Therefore, a glass of special composition is necessary which also ensures that the arc extinguishing gas cannot be released during lamp life.

In the discharge lamp according to U.S. Pat. No. 5,585,693, a capsule filled with metal hydride powder is placed in the vicinity of the electrode. In one of the embodiments, a wire supporting the capsule is sealed into the glass of the pinched stem. In this case, however, the radiated heat is insufficient. In another embodiment, this wire is sealed to the current lead wires across an electrically insulating glass bead for a better heat transfer. The metal hydride used in the capsule is preferably titanium hydride, but zirconium or hafnium hydride or the alloy thereof may also be chosen which may be further alloyed with cobalt, iron, nickel, manganese, lanthanum or with the combination thereof.

The capsule may be made of steel or another metal alloy, and it is closed by crimping after filling the powder. Crimping, however, is not a gas-tight seal and so the hydrogen gas released from the metal hydride can get out from the capsule into the discharge space of the lamp. In this structure, the use of the capsule as a separate part is a disadvantage.

In the structure according to U.S. Pat. No. 5,705,887, a paste containing metal hydride is deposited on the current lead wire from which hydrogen is released in order to extinguish the discharge. The paste is applied to the surface of a glass bead also used as a support component preferably in two portions, so that no arc-over is caused between the lead wires. Fine titanium hydride powder is mixed to the paste. This structure has the disadvantage that the paste on the lead wire reaches the temperature at which the hydrogen is released from the titanium hydride with a significant delay only. In addition, titanium hydride decomposes at a higher temperature.

One of the greatest disadvantage of all known structures is that the temperature increases continuously rather than abruptly at the end of life due to their higher thermal inertia. This has the consequence that the lamp is capable of maintaining an increased temperature for a too long period which may lead to end of life damage.

It is therefore seen to be desirable to develop a discharge lamp in which the arc extinguishing occurs within a time period short enough to prevent the lamp from overheating.

BRIEF SUMMARY OF THE INVENTION

In an exemplary embodiment of the present invention, a discharge lamp comprises a discharge tube having discharge electrodes at both ends thereof. Two lead wires are connected to each of said electrodes that lead to the outside atmosphere from the inside of the discharge tube. The discharge tube contains a fill as an arc discharge generating and sustaining medium. A tungsten coil is connected to at least one lead wire of at least one electrode and placed adjacent to said electrode. At least one material selected from the group consisting of calcium carbonate, barium carbonate and strontium carbonate is applied to the inside and the surface of the tungsten coil.

This structure has the advantage that the discharge arc jumps over from the electrode to the tungsten coil when the emission ability of the electrode significantly decreases. This causes such an abrupt temperature increase in the tungsten coil that the extinguishing gases are released quickly and intensively, and promptly extinguish the discharge. Calcium carbonate, barium carbonate or strontium carbonate or a mixture thereof applied to the tungsten coil are suitable materials for exerting their gas emission capability more efficiently than in other structures of the prior art.

DETAILED DESCRIPTION OF THE INVENTION

Figure 1:
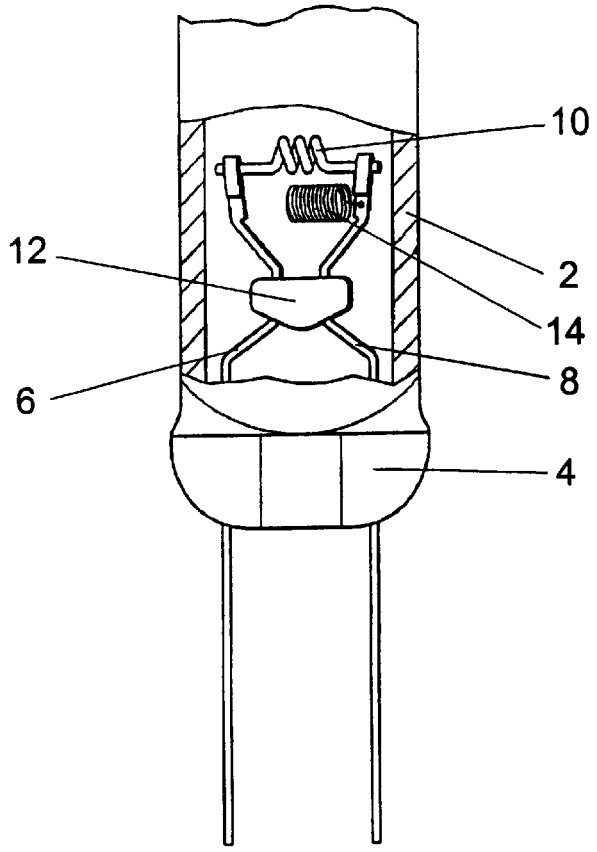
FIG. 1 is a partly sectional view of an end of a discharge lamp with an arc extinguishing tungsten coil.

FIG. 1 shows an end of a discharge lamp with an end of life arc extinguishing structure partly in section. A glass bulb 2 of the discharge lamp is sealed with a pinch 4 into which lead wires 6 and 8 are embedded. The ends of lead wires 6 and 8 inside the bulb 2 are connected to the two ends of an electrode 10 coated with electron emission material, and the ends of the lead wires 6 and 8 outside the bulb 2 are connected to an electric power supply (not shown in the figure) of the discharge lamp. In this embodiment, the lead wires 6 and 8 are embedded in a glass bead 12 between the pinch 4 and the electrode 10 in order to ensure a higher mechanical strength.

The fill of the lamp contains an arc discharge generating and sustaining medium which is known from the prior art. One end of a tungsten coil 14 is fixed to one of the lead wires 8 by spot welding 16. Due to this, the mechanical support of the coil 14 has a reliable mechanical strength and the electrical connection of the coil is also ensured, so that the coil 14 is always at the same potential as the lead wire. In addition, spot welding is a usual operation in the manufacture of discharge lamps which results in a minimum extra cost. The coil 14 is placed behind the electrode 10 if viewed from the discharge path, so that the coil 14 does not disturb the discharge process and does not take part in it in normal lamp operation. It is preferable if the turns of the coil 14 are coiled tightly to each other.

At least one material selected from the group consisting of calcium carbonate, barium carbonate and strontium carbonate is deposited in the inside and on the surface of the coil 14, e.g. by dipping, as a material decomposing by heat. Some bonding material known in itself is mixed to this material in order that the carbonates safely adhere to the coil 14 over the entire life of the lamp.

Figure 2:
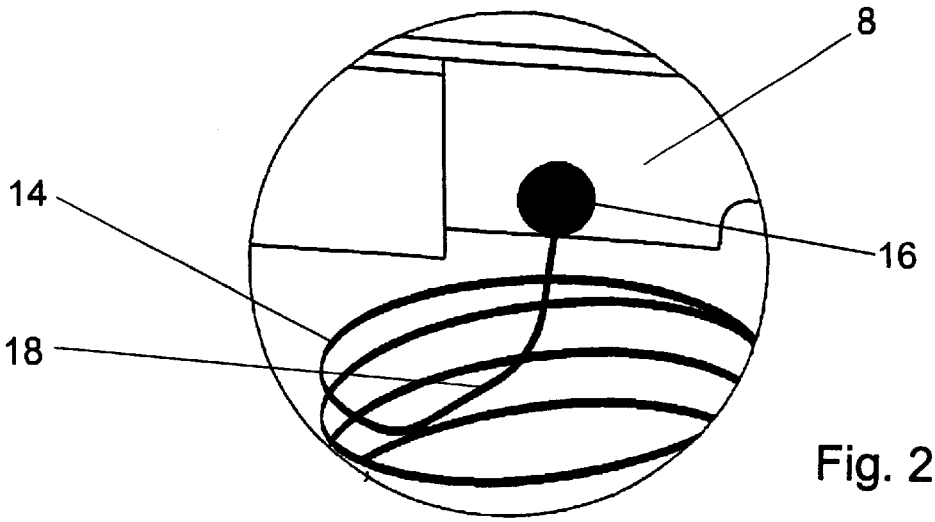
FIG. 2 shows the connection of the tungsten coil seen in FIG. 1 to a lead wire, and the construction of the end of the coil
Figure 3:
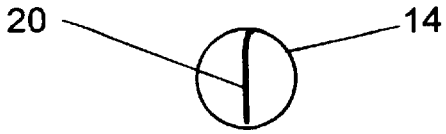
FIG. 3 is a side view that illustrates how the coil is closed.

During depositing the material decomposing by heat on the tungsten coil 14 by dipping, a greater part of the material will get into the space enclosed by the coil 14. In order that the material decomposing by heat remains safely in the space enclosed by the coil 14 over the entire life of the lamp, this space is closed at the ends of the coil 14 and the turns of the coil 14 closely fit to each other. It is not necessary to close the space completely, it is sufficient to keep the carbonate particles depositing in chips in the inside of the space. In accordance with this, a substantially diametric bending 20 is formed from the wire of the coil 14 at the ends thereof as it is seen in FIGS. 2 and 3.

It is also possible to close the space of the coil 14 in another way, e.g. so that the wire at the end the of coil continues in the form of a narrowing coil. This embodiment permits an easy manufacture of the coil. At the end of lamp life, the electron emission material is consumed from the electrode 10 which is now substantially a pure metal only and emits merely a small amount of electrons. Simultaneously, the voltage of the lamp increases. At this time, the temperature of the electrode also increases which in turn raises the temperature of the coil 14 partly by the heat radiated by the electrode 10 and partly by the heat conducted by the lead wire 8 from the electrode 10. In addition, it is highly probable that the arc will jump over to the coil 14 from the electrode 10 which results in an abrupt growth of the coil temperature. The carbonates applied to the coil 14 will decompose and a releasing $C0_2$ gas finally extinguishes the arc. In this way, the lamp is prevented from operating at high temperature at the end of life, which can cause damage also to the component parts in the environment of the lamp.

Measurements were made in order to identify the extent of influence of the tungsten coil 14 on the operation of the discharge lamp. Characteristics of the fill gas were measured at different conditions. It was checked whether the end of life structure adds any contamination to the fill gas during the manufacturing process. Measurement results are shown in the table below.

| Sample # | Gas content (mbar*cm$^3$) | $H_2$ (ppm) | CO (ppm) | $N_2$ (ppm) | Ne (%) | Ar (%) | $CO_2$ (ppm) |
|---|---|---|---|---|---|---|---|
| 1. | 179 | 10 | 10 | 100 | 40 | 60 | 8 |
| 2. | 181 | 10 | 10 | 250 | 40 | 60 | 8 |
| 3. | 179 | 10 | 10 | 200 | 40 | 60 | 4 |
| 4. | 179 | 10 | 10 | 140 | 40 | 60 | 5 |
| 5. | 181 | 10 | 10 | 270 | 40 | 60 | 7 |

These data show that during the manufacturing process the end of life structure did not add any contamination to the fill gas at room temperature.

The effect of the temperature on the total gas evolution of the electrode structure was also investigated. The gas quantities, shown in the table below, are measured in normal cm$^3$.

| Sample | Up to 200° C. | Up to 550° C. |
|---|---|---|
| empty coil | $2.60*10^{-06}$ | $1.17*10^{-04}$ |
| Spiral filled with 0.1 g carbonate | $4.00*10^{-05}$ | $5.70*10^{-02}$ |
| Spiral filled with 0.1 g carbonate | $4.00*10^{-05}$ | $5.20*10^{-02}$ |
| Spiral filled with 0.2 g carbonate | $1.50*10^{-05}$ | $1.90*10^{-02}$ |

The table illustrates that the total gas evolution increases rapidly above 200° C.

Evolution of different gases in the case of empty coil and a coil filled with arc extinguishing carbonate were also measured.

| T (° C.) | Empty coil CO | Filled coil CO | Empty coil $CO_2$ | Filled coil $CO_2$ | Empty coil $H_2$ | Filled coil $H_2$ |
|---|---|---|---|---|---|---|
| 100 | 0 | 3.0 | 90 | 0.9 | 0.1 | 0.3 |
| 200 | 0 | 2.7 | 0 | 8.5 | 0.1 | 0.7 |
| 250 | 0 | 130.0 | 0 | 30 | 0.1 | 8.0 |

As it is shown, the CO and $CO_2$ evolution increases abruptly above 200° C.

What is claimed is:

1. A discharge lamp comprising a discharge tube having discharge electrodes (10) at both ends thereof, two lead wires (8) connected to each of said electrodes (10) and leading to the outside atmosphere from the inside of the discharge tube, a fill within the discharge tube, said fill being arc discharge generating and sustaining medium, a tungsten coil (14) connected to at least one lead wire (8) of at least one electrode (10) and placed adjacent to said electrode (10), and at least one material selected from the group consisting of calcium carbonate, barium carbonate and strontium carbonate being applied to the inside and the surface of the tungsten coil (14).

2. The discharge lamp of claim 1 in which the turns of the tungsten coil (14) closely fit to each other and the end of the tungsten coil (14) is closed at least partly with the wire of the coil.

3. The discharge lamp of claim 2 in which the wire at the end of the tungsten coil (14) continues in the form of a narrowing coil.

4. The discharge lamp of claim 2 in which a bending (20) is formed from the wire at the end of the tungsten coil (14) substantially in a direction of the diameter of the coil.

5. The discharge lamp of claim 1 in which the tungsten coil (14) is fixed to the lead-wire (8) by spot welding (16).

6. The discharge lamp of claim 1 in which the at least one material selected from the group consisting of calcium carbonate, barium carbonate and strontium carbonate is applied in a form mixed with a bonding material.

* * * * *